United States Patent [19]

Drouin

[11] 4,109,637

[45] Aug. 29, 1978

[54] LATCH MECHANISM FOR PYROLYTIC RANGE

[75] Inventor: Claude Drouin, Montmagny, Canada

[73] Assignee: Les Industries BFG Limitee, Montmagny, Canada

[21] Appl. No.: 757,433

[22] Filed: Jan. 6, 1977

[51] Int. Cl.[2] ..... F23M 7/00

[52] U.S. Cl. ..... 126/197; 292/DIG. 69

[58] Field of Search ..... 292/DIG. 69, 201, 122, 292/DIG. 49; 126/197; 70/263, 264, 265

[56] References Cited

U.S. PATENT DOCUMENTS

| | | | |
|---|---|---|---|
| 784,064 | 3/1905 | Nordenberg | 200/5 R |
| 971,423 | 9/1910 | Walters | 292/201 |
| 2,934,930 | 5/1960 | Garvey | 292/201 |
| 3,767,242 | 10/1973 | Quantz | 292/201 |
| 3,968,983 | 7/1976 | Heit et al. | 292/DIG. 69 |

*Primary Examiner*—John J. Camby
*Assistant Examiner*—Larry I. Schwartz

[57] ABSTRACT

The disclosure herein describes a locking mechanism for the door of a pyrolytic range having a high temperature self-cleaning cycle; the mechanism includes a latch arm pivotally mounted to the oven frame of the range and adapted to move between a door locking position and a door unlocked position; a pair of solenoids, each including a movable magnet bar, are coupled to the latch arm so that the bars may be simultaneously displaced for each separate energization of the solenoids; spring means are used to maintain the latch arm in each position reached by the arm.

5 Claims, 3 Drawing Figures

LATCH MECHANISM FOR PYROLYTIC RANGE

FIELD OF THE INVENTION

The present invention relates to a latch mechanism for maintaining the oven door of a pyrolytic range closed during the high temperature self-cleaning cycle of the range.

BACKGROUND OF THE INVENTION

Up until now, it has been a common practice to provide, in a pyrolytic range, an oven door latch that is manually operable and that requires two operations: first the latch is set in locking engagement with the door and secondly a button is pressed to disengage the latch prior to unlocking the door. One example of a manually door latch mechanism is described in the U.S. Pat. No. 3,125,365 issued Mar. 17, 1964.

Another type of door locking assembly consists of a mechanism associated with an oven door in which the door cannot be locked unless the oven is connected to its source of power and, when locked, can only be unlock when the oven is below a certain temperature or cannot be unlocked so long as the oven is above this temperature. Examples of such locking assemblies are described in U.S. Pat. No. 3,521,618 issued July 28, 1970 and U.S. Pat. No. 3,831,580 issued Aug. 27, 1974. These systems generally consist of a latch which engages the door and locks it every time the door is closed even for normal cooking. In some systems a solenoid is used to prevent the latch from being moved during the self-cleaning cycle. However, if there is a power failure, the latch mechanism is de-energized. This condition is unwanted since the oven can accidently be opened with temperatures inside the oven still above the acceptable limit.

OBJECTS AND STATEMENTS OF THE INVENTION

It is an object of this invention to provide a latch mechanism for a self-cleaning pyrolytic range wherein the latch mechanism is set only during the self-cleaning cycle and wherein, should there be a power failure, the door will remain lock to thereby provide an additional protection.

It is a further object of this invention to provide a latch mechanism which includes circuit means that will provide an automatic unlocking oven door.

It is a further object of this invention to provide a latch mechanism where no power is additionally provided to the latching system except for the locking and unlocking operations.

These objects are achieved by providing a pair of solenoids, the function of one being to set the locking engagement while the function of the other is to cause the unlocking of the door. The action of both solenoids is instantaneous: a switch disconnects each solenoid as soon as the run of its magnet bar is completed. Also, this switch serves as a protective device and ensures the automatic closing of the door before power is connected for the self-cleaning operation of the oven.

In one embodiment of the invention, a spring ensures the maintaining of the latch mechanism in both positions, i.e. the door locking position and the door unlocked position; this action of the spring will prevent vibrations to accidently change the setting of the latch mechanism and also assist in the transitional movements of a latch arm associated with the latch mechanism.

One advantage of the present invention is that the operation is entirely electrical and only requires the use of a manual control on the range panel for setting the self-cleaning cycle in operation.

The present invention therefore relates, in its broadest aspect, to a locking mechanism for the door of a pyrolytic range which comprises: a latch arm pivotally mounted to the structure of the oven and adapted to move between a door locking position and a door unlocked position, the arm having one end extending towards the door for locking engagement therewith; a pair of solenoids mounted to the structure, each solenoid including a movable magnet bar coupled to the latch arm whereby the bars may be simultaneously displaced for each separate energization of the solenoids, a first bar being actuatable, when the solenoid associated therewith is energized, to move the arm to the door locking position; a second bar being actuatable, when the solenoid associated therewith is energized, to move the arm in the unlocked position whereby the door may be opened; and spring means maintaining the door in each position reached by the arm.

Other objects and further scope of applicability of the present invention will become apparent from the detailed description given hereinafter; it should be understood, however, that the detailed description while indicating preferred embodiments of the invention is given by way of illustration only since various changes and modifications within the spirit and scope of the invention will become apparent to those skilled in the art from this detailed description.

DESCRIPTION OF A PREFERRED EMBODIMENT

Figure 1:
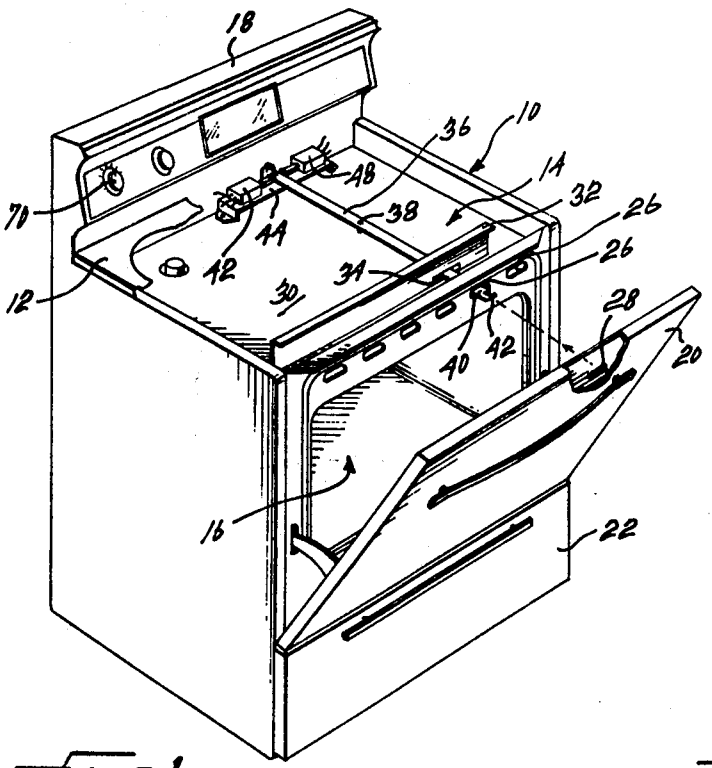
FIG. 1 is a perspective view of a pyrolytic range embodying the present invention with portions broken away in order to show the construction.

Referring to FIG. 1, there is shown a pyrolytic range 10, the structure of which includes, underneath the top cooking surface 12 (partly cut away) an oven structure or liner 14 defining an oven cavity 16 therewithin. The range further includes a control panel 18, a door 20 hingedly mounted to the oven liner 14 and a drawer 22.

The front wall 24 of liner 14 includes a series of air evacuation openings 26 one of which is adapted to come in alignment with an opening 28 provided on the inside face of door 20. The top insulated wall 30 of liner 14 includes a baffle 32 having an opening 34 therethrough also in registry with openings 26 and 28.

The latch mechanism of the present invention is mounted to the top of the liner and includes a latch arm 36 pivotally mounted at 38 over top wall 30. The latch arm has one end 40 shaped with a hook portion 42 which is adapted to engage in opening 28 of the door. The latch arm 36 extends towards door 20 through openings 34 and 26. The opposite end of latch arm 36 extends over a baseplate 44 fixedly mounted to top wall 30 of liner 14 by means of appropriate fastening means 50.

A pair of solenoids 46 and 48 are fixedly secured on baseplate 44. Each solenoid 46,48 includes a magnet bar 52,54 which is pivotally mounted to a first end 43 of latch arm 36. Baseplate 44 includes a rear upturned portion 56 provided with an opening (not shown) that receives one extremity of a spring 58. The opposite extremity of spring 58 is received in an opening 60 provided in extremity 43 of the latch arm.

Figure 2:
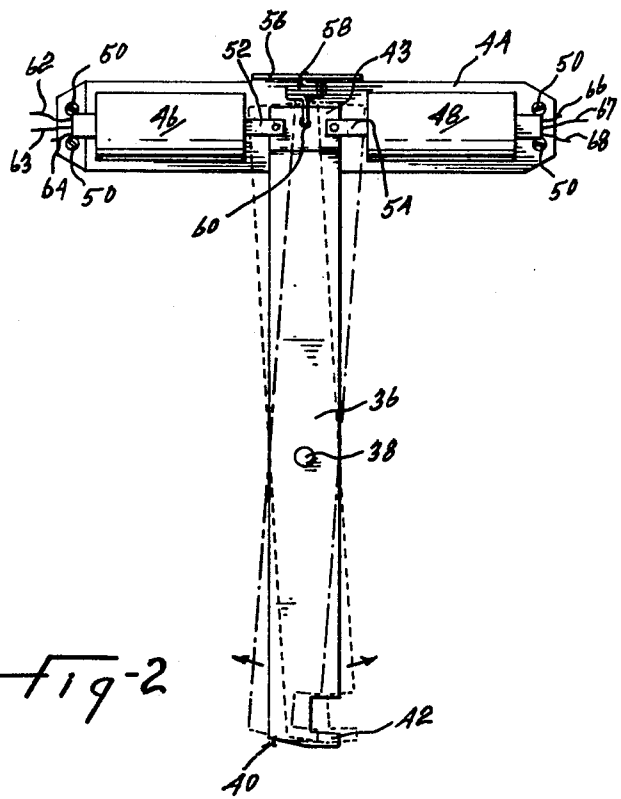
FIG. 2 is an enlarged detailed view of a locking mechanism showing the movement of the latch arm in both positions.

As can be seen in FIG. 2, since both magnet bars are coupled to the latch arm, the horizontal displacement of one magnet bar 52 or 54 as result of separate energization of respective solenoid 46,48 causes, in addition to a pivotal movement of latch arm 36 about point 38, a displacement, of the other magnet bar in its solenoid.

Spring 58 is in a compressed state so that, when the latch arm passes the intermediate unstable position (represented by the latch arm in full lines in FIG. 2), the spring urges the latch arm to move quickly in one of the two positions described above. Furthermore, in each position, the force in the spring prevents accidental displacement of the latch arm due to vibrations in the pyrolytic range.

Each solenoid includes a three prong switch to which is connected a series of connections 62,63,64 for solenoid 46 and 66,67,68 for solenoid 48.

Figure 3:
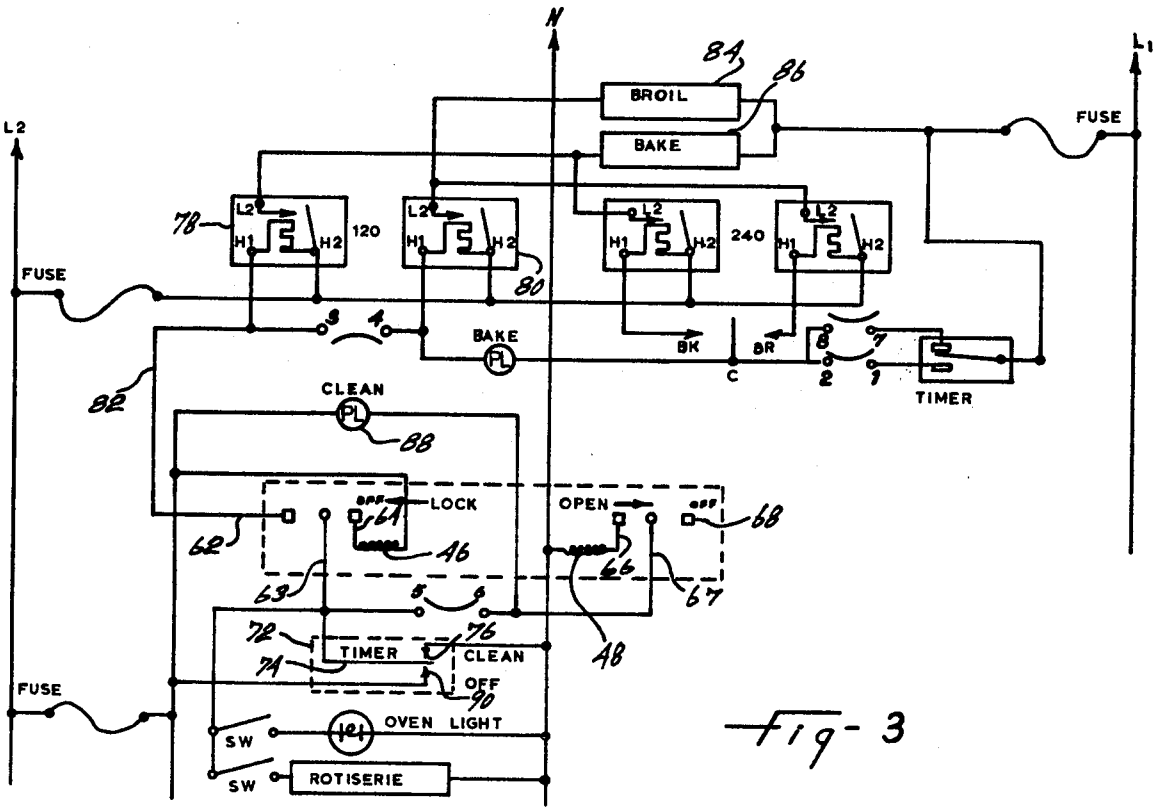
FIG. 3 is a fragmentary diagram of the electrical circuit used in a pyrolytic range embodying the present invention.

Referring to FIG. 3, there is shown part of a circuit diagram of a pyrolytic range, which part relates to the operation of the present latching mechanism in connection with the self-cleaning cycle of the range. The circuit diagram represents the operation of the latching mechanism in the unstable position of the latch arm 36 shown in full lines in FIG. 2. In normal use, i.e. when the oven is not in the self-cleaning operation, 63 and 64 are connected as well as 67 and 68. The self-cleaning cycle is set by manually controlling a button 70 on the range panel 18 which sets the timer 72 in operation; hence, timer switch 74 moves to the CLEAN position 76 connecting the solenoid 46 between line L2 and neutral N. The energization of solenoid 46 causes actuation of magnet bar 52 and connection of 63 with 62. Simultaneously, arm 36 moves in a locking engagement with the door and magnet bar 54 of solenoid 48 is displaced due to its coupling to arm 36. Thermo relays 78 and 80 are energized through line 82 and normally closed thermostat switch 3–4 causing the activation of broil element 84 and bake element 86. Simultaneously, pilot light 88 which is connected between line L2 and neutral N via the normally closed thermostat contact 5–6, is lit.

The thermostat 3–4 may be pre-set to open when the temperature inside the oven cavity is in the neighborhood of 900° F, for example, thereby disconnecting the broil element 84 (which may have a wattage of 3000w) and leaving only the bake element 86 (which may have a wattage of only 1500w).

The thermostat 5–6 may be pre-set to open when the temperature inside the oven cavity is in the neighborhood of 550° F, for example; however, the pilot light still remains ON due to its line connection to the neutral via the solenoid 48.

One important feature on the present diagram is that, should there be a power failure, the door will remain locked since no energization is required to maintain the door in the locked position.

When the self-cleaning cycle is terminated, the timer switch 74 returns to the OFF position 90 whereby thermo relay 78 opens. As the temperature inside the oven cavity decreases, say to a temperature of 550° F, thermostat contact 5–6 closes establishing connection between line L2 and neutral via contact 90, closed thermostat 5–6, lines 67–66 and solenoid 48 which is thereby energized, causing inward movement of magnet bar 54 in the solenoid and opening arm 36 to the unlocked position. Connection 67–68 is effected and pilot light 88 is closed.

What is claimed is:

1. A combination pyrolytic range, having a high temperature self cleaning cycle and a latch mechanism therefor comprising an oven structure, an oven cavity defined in said oven structure and a door for covering said oven cavity, and a locking mechanism for said door during said self-cleaning cycle comprising: a latch arm pivotally mounted to said oven structure and adapted to move between a door locking position and a door unlocked position, said door having means for receiving said latch arm, said arm having one end extending towards said door for locking engagement therewith; a pair of solenoids mounted to said structure, each solenoid including a movable magnet bar coupled to said latch arm whereby said bars are simultaneously displaceable for each separate energization of said solenoids; a first of said bars being actuatable, when the solenoid associated therewith is energized, to move said arm to said door locking position; a second of said bars being actuatable, when the solenoid associated therewith is energized, to move said arm in said door unlocked position; and spring means maintaining said arm in each position reached by said arm.

2. The combination according to claim 1, wherein said pair of solenoids are fixedly mounted on a baseplate secured to the top wall of said oven structure; the opposite end of said latch arm being disposed adjacent said baseplate.

3. The combination according to claim 2, wherein each said magnet bar is connected to said opposite end of said latch arm.

4. The combination according to claim 3, wherein said spring means has one end attached to said baseplate and the opposite end thereof attached to said opposite end of said latch arm.

5. The combination according to claim 1, further comprising circuit control means for energizing said solenoids to lock and unlock said door and to set said high temperature self-cleaning cycle in operation; said control means include first thermostat means disconnecting heating elements when the temperature inside said oven cavity exceeds a first predetermined temperature; said control means further including second thermostat means preventing said door to be opened until a second predetermined temperature has been reached.

* * * * *